United States Patent [19]

Sikora et al.

[11] 4,070,147

[45] Jan. 24, 1978

[54] METHOD AND APPARATUS FOR POST-WELD HEAT TREATING A TANK

[75] Inventors: Orwill Granger Sikora, Houston; Donald Sheneman, Spring, both of Tex.

[73] Assignee: Chicago Bridge & Iron Company, Oak Brook, Ill.

[21] Appl. No.: 672,733

[22] Filed: Apr. 1, 1976

[51] Int. Cl.[2] ..... F27D 1/00

[52] U.S. Cl. ..... 432/5; 432/224

[58] Field of Search ..... 432/1, 3, 5, 224, 225, 432/226

[56] References Cited

U.S. PATENT DOCUMENTS

| | | | |
|---|---|---|---|
| 655,092 | 7/1900 | Kopping | 432/224 |
| 896,070 | 8/1908 | Williams | 432/224 |
| 1,037,013 | 8/1912 | Jones | 432/224 |
| 2,294,168 | 8/1942 | Francis et al. | 432/224 |
| 2,705,627 | 4/1955 | Norgaard | 432/224 |
| 2,772,082 | 11/1956 | Hortvet | 432/224 |

*Primary Examiner*—John J. Camby

*Attorney, Agent, or Firm*—Merriam, Marshall, Shapiro & Klose

[57] ABSTRACT

A method of heating a closed metal shell defining a tank having top and bottom portions, comprising positioning a substantially vertical metal tube to extend upwardly from about the bottom of the tank to an opening in the tank top, said tube having insulation for retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

An assembly comprising a closed metal shell tank fabricated by welding and requiring post-weld heat treatment, insulation on substantially the entire exterior surface of the tank, a substantially vertical metal tube extending upwardly from the bottom of the tank to an opening in the tank top, said tube having insulation for retarding heat flow from the tank interior space into the tube interior space, a plurality of hot gas exhaust ports in the tank top portion communicating with the tank upper interior space and the atmosphere, and at least one burner in the bottom portion of the tube.

12 Claims, 5 Drawing Figures

METHOD AND APPARATUS FOR POST-WELD HEAT TREATING A TANK

This invention relates to metal tanks. More particularly, this invention is concerned with novel assemblies for heating large size tanks, such as those which are field-erected, for effecting post-weld heat treatment.

Metal tanks are widely used for an extensive number of purposes. The term "tanks" as used herein is intended to also encompass metal containers and vessels. Most tanks are metal shells fabricated by welding metal plates together. Fabrication of a tank by welding steel plates together induces high stresses in the metal plates, particularly adjacent the welded joints. As a result, many engineering specifications require that the metal shell be stress relieved by a post-weld heat treatment prior to putting the tank in service.

Relatively small sized steel tanks are readily post-weld heat treated in shop furnaces. However, large size tanks, and particularly those which are field-fabricated, cannot conveniently be heated in a furnace because of their size. Other means are accordingly used to bring the tank up to the high stress-relieving temperatures, e.g. up to about 1000° to 1200° F., needed to effect post-weld heat treatment.

One prior art method of heating a large tank is to produce a continuous stream of hot gases by means of a furnace outside of the tank and to then blow the hot gases through a conduit to the tank. The tank is exteriorly insulated to retard heat loss. This heating system requires an expensive furnace and a large blower. It is an expensive method not because of this alone but also because of the auxiliary equipment, set-up time and labor which are required.

Another prior art method of heating a large tank is to build a furnace around the tank with a plurality of burners around the outside of the furnace enclosure. This can create problems if the bottom cannot reach required post-weld heat treatment temperature levels due to heat losses through the foundation and requires expensive solutions to overcome them.

Another prior art method of heating a tank of large size is to position outside of the tank a plurality of burners which face into openings in the lower portion of the tank wall. The outer surface of the tank is covered with insulation before heating is begun. Air is supplied to the burners by gravity from the surrounding atmosphere. The resulting combustion of a hydrocarbon fuel, such as oil or propane, provides a luminous flame and hot gases which heat the tank. The hot gases are exhausted through the roof of the tank at a controlled rate to maintain the tank at the proper elevated temperature for stress relieving. Although this method is quite extensively used, it is unsuitable for post-weld heat treating tanks having engineering specifications which prohibit openings in the tank bottom, or side wall. As is obvious, openings in the tank wall or bottom portion are needed to use this method. Although the openings may be subsequently sealed by bolting covers on prepositioned flanges around the openings, such a closure system is not acceptable for some engineering specifications such as, for example, a tank to be used for disposal of radioactive material, stress corrosion, lethal service, etc.

According to the present invention, there is provided a novel method of heating a closed metal shell, defining a tank, which employs at least one burner located inside of the tank in the lower bottom space thereof. The only openings required in the tank for practicing the method can be positioned in the upper portion of the metal shell and these openings can be limited to exhaust ports for venting hot gases from the tank and one or more openings for a tube through which atmospheric air can flow downwardly by gravity to supply the burner with sufficient oxygen to burn a fuel, desirably a hydrocarbon fuel, in the burner. Besides hydrocarbon fuels such as methane, ethane, propane, fuel oil and the like, nonhydrocarbon fuels, and particularly hydrogen, may be used. The invention also provides a novel assembly for use in practicing the method.

The method provided by the invention for heating a closed metal shell defining a tank, having top and bottom portions, comprises positioning a substantially vertical metal tube to extend upwardly from about a bottom interior space of the bottom portion of the tank at least to an opening in a top portion of the tank, said tube having means for substantially retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

According to a second aspect of the invention there is provided an apparatus assembly which can be used in practicing the described method. The apparatus assembly includes, in combination, at least the apparatus elements used in the described method.

It is important that the space inside of the tube be at a temperature which is substantially lower than the temperature inside of the tank, when the tank is being heated, to induce downward flow of air in the tube. To prevent heat flow from the tank interior space into the tube interior space a suitable means is provided on or in close association with the tube. One means of retarding such heat flow is to provide the tube with passageways for the circulation of cooling water through the tube. An alternative but more suitable means is to provide a layer of insulation material on either the inside or the outside surface of the tube over about the entire length of the tube inside of the tank.

As the temperature of the metal shell, which is usually steel, increases during post-weld heat treatment the strength of the metal is reduced. As a result, a tank with a conical or domed roof will not withstand as high a load on top as when the tank is at ambient temperature. However, the tube can be used to support the roof during heating by placing the tube lower end on the internal bottom surface of the tank, or on a supporting base therein, and by joining the tank roof to the adjacent upper part of the tube. When the tube is used as a support for the roof in this manner, it is advisable to place insulation on the inside surface of the tube to retard heat flow and to prevent the interior space of the tube from becoming hot. By placing the insulation on the inside of the tube, the tube is placed in direct contact with the hot gases produced in the tank by the burner. As a result, the tube becomes hot and expands in length at a rate about equal to the heat-induced expansion in height of the tank wall and roof. Of course, the tube contracts upon cooling at about the same rate as does the metal shell of the tank.

The metal tube may also be suspended from the metal shell upper portion with the lower end of the tube located unsupported above the bottom interior surface of the tank. Alternatively, the tube may be suspended by some exterior supporting framework, such as a boom or bridge built to extend over the top of the tank. Regardless of whether the tube is suspended by means exterior of the tank or by joining the tube to a top portion of the tank, it is advisable for the suspended tube to be insulated on its exterior surface. In this way, the interior space of the tube is maintained at a temperature not much higher than the temperature of the atmospheric air flowing downwardly in the tube during the heating process. It is feasible, however, to insulate the interior surface of a suspended tube.

To retard heat loss from the metal shell during heating, the exterior surface of the shell is advisably covered essentially completely with a suitable layer of insulation material. It will be readily apparent to those skilled in the art that many suitable conventional high temperature insulating materials may be used for this purpose.

The vertical tube may have one or more burners mounted in the bottom portion thereof to provide the necessary heat. Each burner is fed a suitable fuel such as oil, natural gas, propane, butane or hydrogen, for combustion with air to provide the necessary hot gases and radiant flame for heating the metal shell. Combustion of the fuel is advisably controlled to provide an elongated luminous flame since such a flame provides a high amount of radiant heat over a large area.

Because heat will radiate through the insulated top portion or roof of the tank during the heating process, it may be advisable for the tube to be extended upwardly a substantial distance above the tank top so as to place the top end of the tube in atmospheric air which is at a lower temperature than the atmosphere in the space immediately adjacent the tank top. For similar reasons, it may be advisable to provide vertical pipes projecting upwardly from the exhaust ports to better exhaust the hot gases into the atmosphere so that they do not adversely affect the downward flow of atmospheric air in the tube.

After the tank has been heated and cooled according to any desired suitable heat treatment cycle, the tube may be removed from the tank and the opening through which it projected closed-off by any suitable means, such as by bolting a cover to a prepositioned flange surrounding the opening. In a similar way the exhaust ports may be closed off. It should be recognized that the tube could be placed in a temporary cover and/or bulkhead prior to installation of the final roof.

It may be advisable at the start of the heating process to force air down the tube to provide enough air to the burners for adequate combustion. However, once hot gases vent from the exhaust ports at a sufficient rate to produce an adequately reduced pressure in the tube to induce downward flow of air, forced air may no longer be supplied.

The invention will be disclosed further in conjunction with the attached drawings, in which.

So far as is practical the same parts or elements which appear in the various views of the drawings will be identified by the same numbers.

Figure 1:
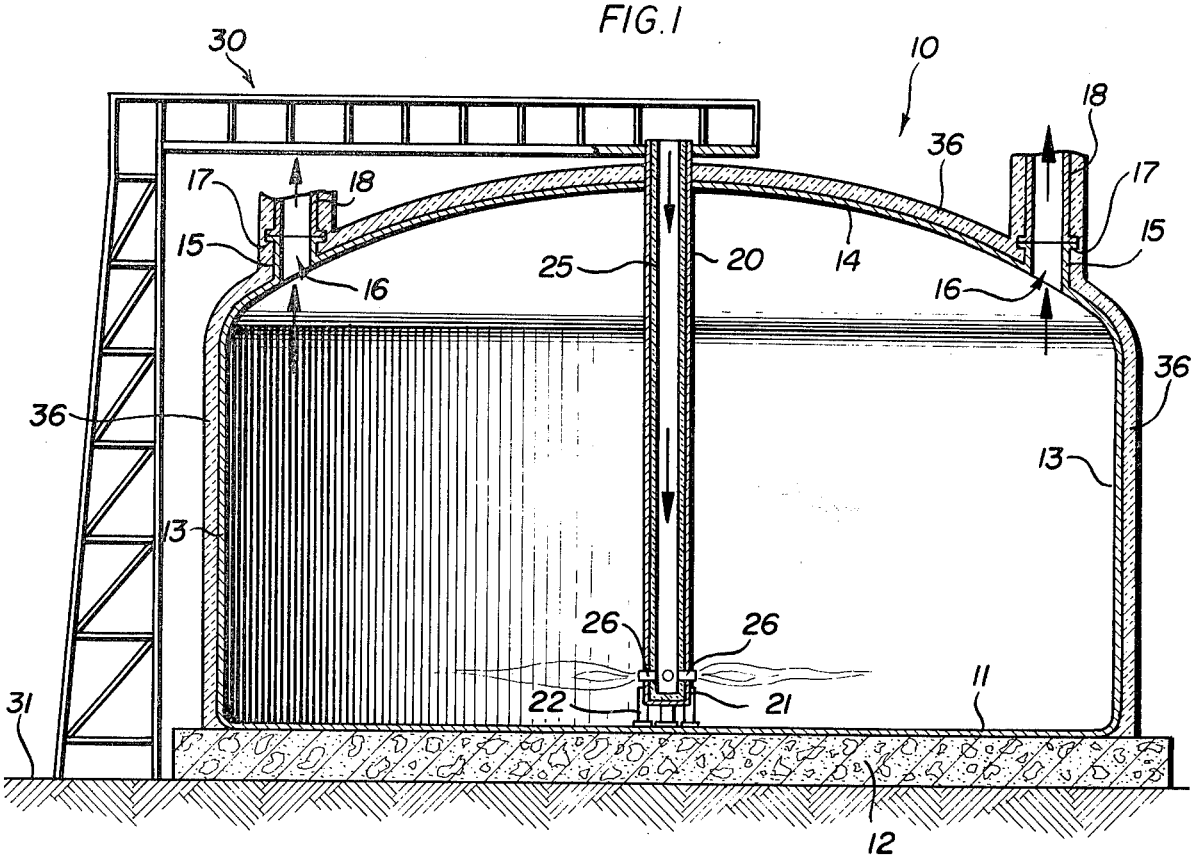
FIG. 1 is a vertical sectional view through a domed storage tank having an air supply vertical metal tube, with burners at the lower end, centrally positioned and supported at its lower end on legs resting on the tank bottom.

The tank 10 shown in FIG. 1 has a flat metal bottom 11 which is supported on a load bearing insulated foundation 12. Vertical cylindrical wall 13 extends upwardly from the circular periphery of tank bottom 11 and it is joined in a smooth arc at the top to domed top or roof 14. The tank 10 including the bottom 11, wall 13 and roof 14 are fabricated by field welding metal plates together. One or more tubular extensions 15 project upwardly from exhaust ports or openings 16 in roof 14. The tubular extensions 15 are provided with top flanges 17 so that they may be sealed off by bolting cover plates thereon. Under certain circumstances welded joints may be desirable. A tube 18 having a flange at its lower end extends upwardly from flange 17.

Vertical tube 20, advisably made of the same method as the tank, is approximately centrally positioned in the tank. Tube 20 is joined at its upper portion to roof 14 and the lower end 21 of the tube is supported by legs 22 which rest on the inside of tank bottom 11. The lower end of the tube is desirably spaced above the tank bottom even though this is not absolutely necessary, to provide proper heating and/or cooling of the tank bottom and to prevent excessive heating of the tube end if it came in contact with the bottom. The interior surface of metal tube 20 is covered by heat resistant insulation 25. One or more burners 26 is mounted in the lower portion of tube 20. Each burner is positioned so it will receive air which flows down the inside of tube 20 so that the air will be available to oxidize a combustible hydrocarbon fuel in each burner 26. The flame and hot gaseous products of combustion from each burner are directed through openings in the lower part of tube 20 into the internal space of tank 10 to thereby heat the tank metal shell to a temperature sufficiently high to effect post-weld heat treatment.

Bridge 30, which is supported on ground 31, provides access for personnel to reach the upper portion of tube 20 to make necessary adjustments in fuel feed lines and other equipment which may be used to regulate and control each burner 26.

The hot gases of combustion circulate throughout the interior space of tank 10 and then are exhausted through ports 16 at a controlled rate to regulate the tank shell temperature to effect the desired heat treatment and stress relief. As the hot gases flow outwardly through exhaust ports 16 there is a reduction in pressure inside of the tank which results in the flow of atmospheric air down inside tube 20 to the space adjacent each burner 26 where it is then used to oxidize the combustible fuel used in each burner. To retard heat loss during the heat treatment process tank 10 is covered externally with insulation 36 on its wall 13 and roof 14. Insulation of the tank bottom 11 externally is generally not required since the load bearing base 12 provides adequate insulation against heat loss.

When the tank increases in temperature it becomes higher through expansion of the metal forming the wall 13 and roof 14. However, the metal tube 20 also expands in length with increase in temperature and thus continues to provide support for roof 14. This support for roof 14 is advantageous since the inherent strength of a metal roof decreases with increase in temperature to the high temperatures of about 1000° to 1200° F. required for heat treatment.

It may be necessary initially to force air down tube 20 to provide adequate oxygen for combustion of the fuel in each burner 26. However, once the flow of hot gases through each exhaust port 16 produces the desired reduced pressure in tank 10 there will be adequate downward flow of atmospheric air in tube 20 to provide all of the oxygen needed for burners 26 without forcing air down the tube.

Figure 2:
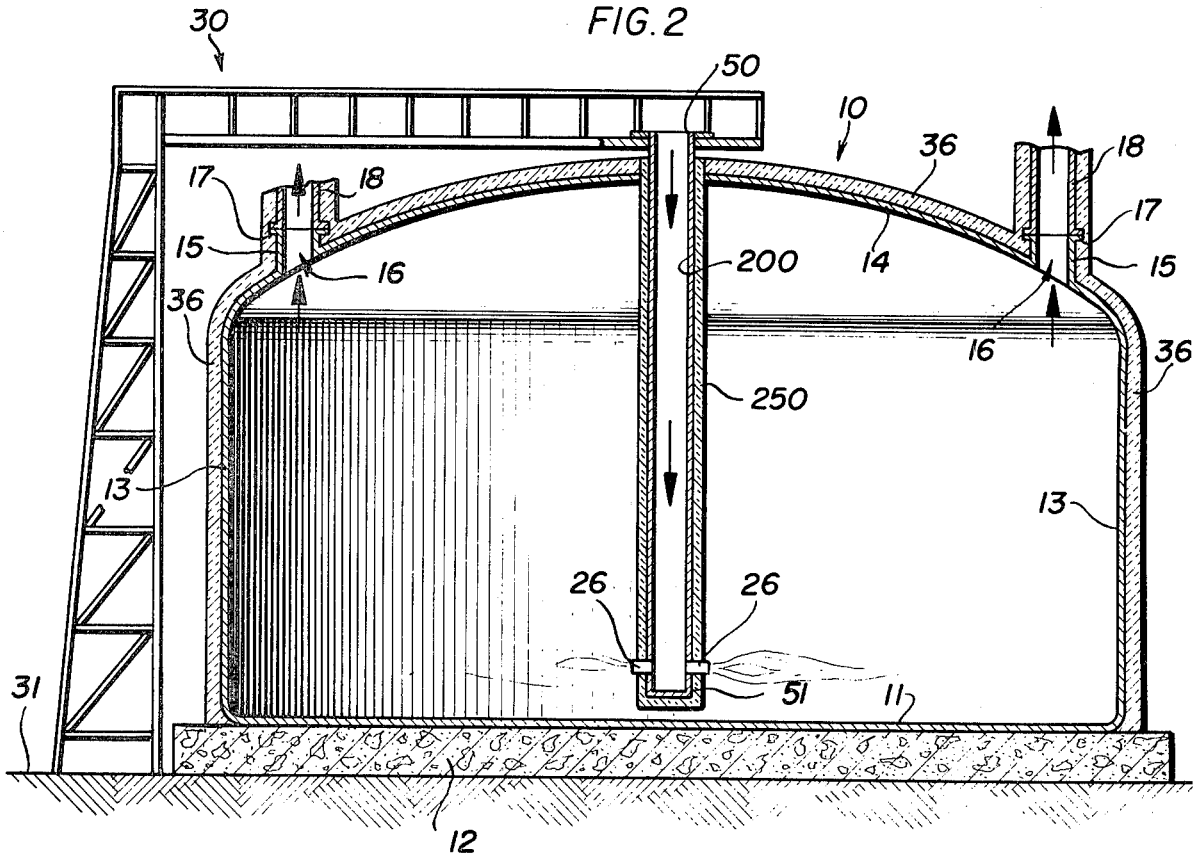
FIG. 2 is like FIG. 1 except that the central tube is unsupported at the bottom and the insulation is placed on the outside of the tube rather than on the inside as shown in FIG. 1.

A second embodiment of the invention is shown in FIG. 2. This embodiment of the invention, however, is very similar to that shown in FIG. 1. As shown in FIG. 2, vertical metal tube 200 is positioned inside of tank 10 and its upper end 50 is supported by bridge 30. The lower end 51 of tube 200 is spaced above the bottom 11 of tank 10 and is not supported thereby. Heat resistant insulation 250 covers the exterior of tube 200 for its entire length in tank 10. The tube 200 and insulation 250 do not constitute a load on tank roof 14 since both are supported by the bridge 30. In this embodiment, however, the tube 200 does not provide support for the roof, although it could be attached to the roof to provide such support.

The tube 200 does not increase significantly in length with temperature increase during heat treatment of tank 10 in the embodiment shown in FIG. 2 because of the presence of insulation 250 outside of tube 200. By keeping the interior of tube 200 comparatively low in temperature the downward flow of atmospheric air at ambient temperature or moderately elevated thereabove, is readily effected through tube 200 because of the differential temperature which is created inside of the tank as the hot gases flow through each exhaust port 16.

Figure 3:
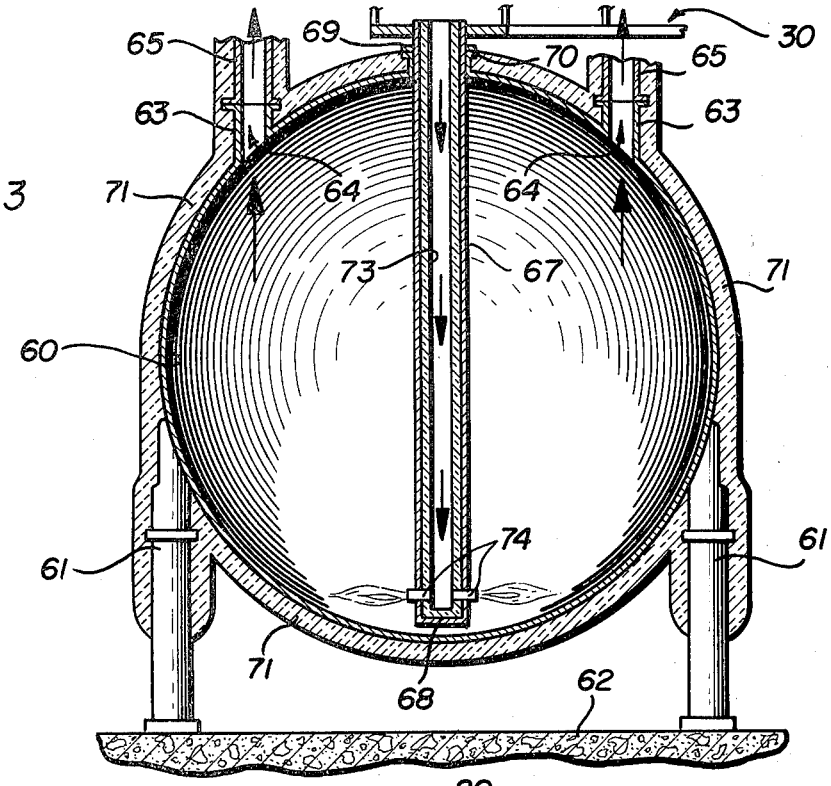
FIG. 3 is a vertical sectional view through the center of a spherical tank having an air supply vertical tube positioned centrally therein.

A third embodiment of the invention is shown in FIG. 3. Spherical metal tank 60 is supported by a plurality of metal legs 61 which rest on foundation 62. The upper portion of tank 60 is provided with one or more tubes 63 which extend upwardly from exhaust ports 64. Tubular extension 65 extends from tube 63 as far upwardly as needed to vent hot gases from the tank during heat treatment. Metal vertical air supply tube 67 projects through a central opening in the upper portion of tank 60 and its bottom closed end 68 is located above the bottom portion of the tank interior. Flange 69 on the upper portion of tube 67 is supported by a flange 70 located at the top of a cylindrical wall 70 which surrounds the central opening in the upper portion of the tank 60. The exterior of tank 60 is covered with heat resistant insulation 71 to reduce heat loss during post-weld heat treatment of the tank. Heat resistant insulation 73 is also positioned on the inside of tube 67. Burners 74 are mounted in the bottom of tube 67 in the same way as burners 26 shown in FIGS. 1 and 2. The tube 67 may be mounted stationary in tank 60 or it may be mounted to revolve along a vertical axis to thereby more evenly distribute the heat inside of the tank during a post-weld heat treatment process. A revolving tube could possibly more effectively heat the tank with fewer burners than a stationary tube.

Figure 4:
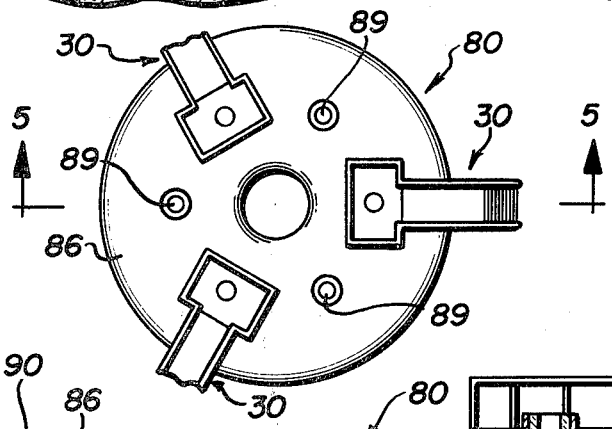
FIG. 4 is a plan view of an annular tank having three air supply vertical tubes with burners at the lower ends for heating the tank.
Figure 5:
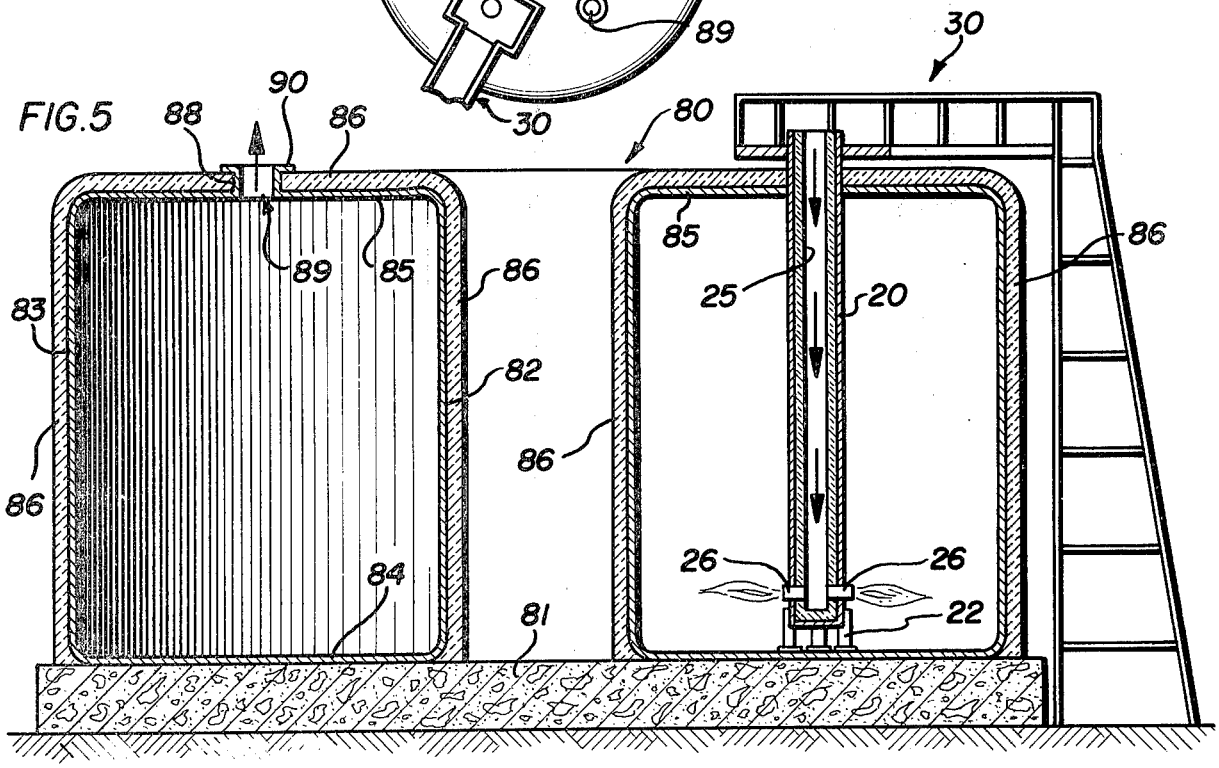
FIG. 5 is a vertical sectional view along the line 5—5 of FIG. 4.

An additional embodiment of the invention is illustrated by FIGS. 4 and 5. As shown in these FIGURES, annular metal tank 80 rests on a foundation 81. The annular tank 80 has an inner vertical cylindrical metal wall 82 and an outer cylindrical metal wall 83. In plan view, the walls 82 and 83 form concentric circles. The walls 82 and 83 are joined at the bottom to a ring-like metal base 84 and at the top to a ring-like metal roof 85. To reduce heat leak during post-weld heat treatment the tank 80 is covered externally with heat resistant insulation 86.

Three vertical tubes 20, covered inside with insulation 25 such as described with respect to FIG. 1, are positioned in tank 80 and access to each tube is provided by a bridge 30. The lower end of the tube 20 is supported on legs 22 and burners 26 are positioned at the bottom of the tube in the same way as described with reference to FIG. 1. Three exhaust ports 89 in the tank roof or top 85 communicate with a pipe 88 having a flange 90 at the top thereof. The hot gases of combustion from burners 26 vent through exhaust ports 89 and in so doing reduce the pressure in the tank resulting in a flow of atmospheric air through the inside of tube 20 downwardly to burners 26 where it is used in the combustion of a suitable fuel.

In each of the described embodiments of the invention air is supplied to the burners in the tank by gravity flow from the atmosphere. Not only does the air permit oxidation of the fuel in this way to heat the tank but, in addition, the downward flow of atmospheric air can be used during the cooling cycle to reduce the tank shell temperature.

The number of air-supply tubes used in any one tank, as well as the size and number of burners, are features readily determined by using available data. Furthermore, dampers may be employed on the exhaust ports to regulate outward flow of hot gases to control the tank temperature. Control of heating, holding at a temperature and/or cooling of the tank can be effected by regulating the burners, the exhaust ports or a combination of these. Sight glasses and/or ports may be used to control and monitor the heating and cooling cycles.

Although the invention is intended primarily for use in tanks above ground level it is also effective for post-weld heat treatment of tanks below ground level or in a hole.

The foregoing detailed description has been given for clearness of understanding only, and no unnecessary limitations should be understood therefrom, as modifications will be obvious to those skilled in the art.

What is claimed is:

1. A method of heating a closed metal shell defining a tank having top and bottom portions, comprising:

positioning a substantially vertical metal tube to extend upwardly from about the bottom interior space of the tank at least to an opening in a top portion of the tank, placing insulation on the interior surface of the tube for substantially retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, placing insulation on the exterior surface of the metal shell, before firing the burner, to retard heat loss, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

2. A method according to claim 1 including supporting the tube by the metal shell bottom portion during heating of the metal shell.

3. A method according to claim 2 including supporting the upper portion of the metal shell by the tube during heating of the metal shell.

4. A method according to claim 1 including suspending the tube in the tank by the upper portion of the metal shell.

5. A method according to claim 1 including suspending the tube in the tank solely by means external of the metal shell.

6. A method of heating a closed metal shell defining a tank having top and bottom portions, comprising:

positioning a substantially vertical metal tube to extend upwardly from about the bottom interior space of the tank at least to an opening in a top portion of the tank, placing insulation on the exterior surface of the tube for substantially retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, placing insulation on the exterior surface of the metal shell, before firing the burner, to retard heat loss, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

7. A method according to claim 6 including suspending the tube in the tank by the upper portion of the metal shell.

8. A method according to claim 6 including suspending the tube in the tank solely by means external of the metal shell.

9. A method according to claim 6 including supporting the tube by the metal shell bottom portion during heating of the metal shell.

10. A method according to claim 9 including supporting the upper portion of the metal shell by the tube during heating of the metal shell.

11. A method of heating a closed metal shell defining a tank having top and bottom portions, comprising:

positioning a substantially vertical metal tube to extend upwardly from about the bottom interior space of the tank at least to an opening in a top portion of the tank, said tube having means for substantially retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, revolving the tube around a vertical axis, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

12. A method of heating a closed metal shell defining a tank having top and bottom portions, comprising:

positioning a substantially vertical metal tube to extend upwardly from about the bottom interior space of the tank at least to an opening in a top portion of the tank, said tube having means for substantially retarding heat flow from the tank interior space into the tube interior space, providing the tank top portion with a plurality of hot gas exhaust ports communicating with the tank upper interior space and the atmosphere, positioning a burner in the bottom portion of the tube, firing the burner with a fuel and directing the resulting flame and hot combustion gases from the burner away from the tube to heat the metal shell, placing insulation on the exterior surface of the metal shell, before firing the burner, to retard heat loss, and controllably venting hot gases from the tank through the exhaust ports to the atmosphere by a natural-draft stack-effect thereby reducing the pressure in the tube and inducing atmospheric air to flow downwardly into and through the tube to the burner to supply oxygen for combustion of the fuel.

* * * * *

UNITED STATES PATENT OFFICE

CERTIFICATE OF CORRECTION

Patent No. 4,070,147 Dated January 24, 1978

Inventor(s) ORWILL GRANGER SIKORA and DONALD SHENEMAN

It is certified that error appears in the above-identified patent and that said Letters Patent are hereby corrected as shown below:

Column 4, line 30, change "method" to --metal--;

Column 7, line 15, change "2" to --1--.

Signed and Sealed this

Thirtieth Day of May 1978

[SEAL]

Attest:

RUTH C. MASON
Attesting Officer

LUTRELLE F. PARKER
Acting Commissioner of Patents and Trademarks